US005193419A

United States Patent [19]

Lee

[11] Patent Number: 5,193,419

[45] Date of Patent: Mar. 16, 1993

[54] WRENCH WITH TELESCOPIC HANDLE

[76] Inventor: Chang-Chuan Lee, P.O. Box 55-1670, Taipei, Taiwan

[21] Appl. No.: 898,152

[22] Filed: Jun. 15, 1992

[51] Int. Cl.[5] ..... B25G 1/04

[52] U.S. Cl. ..... 81/177.2; 403/324; 403/4; 81/177.5

[58] Field of Search ..... 81/177.1, 177.2, 177.8, 81/177.9, 177.5, 489; 403/324, 4

[56] References Cited

U.S. PATENT DOCUMENTS 1,753,441 4/1930 Morehouse ..... 81/177.2 X 3,561,510 2/1971 Johnson ..... 81/177.5 X 3,672,419 6/1972 Fischer ..... 81/177.5 X 4,645,368 2/1987 Simpson et al. ..... 403/324 X

*Primary Examiner*—D. S. Meislin

[57] ABSTRACT

A wrench includes a handle portion of the wrench telescopically mounted in a handle sleeve having a locking bolt resiliently held on the handle sleeve for locking the handle portion in the handle sleeve by engaging the locking bolt with anyone transverse groove transversely formed in the handle portion, thereby providing a wrench having an adjustably telescopic handle.

3 Claims, 3 Drawing Sheets

WRENCH WITH TELESCOPIC HANDLE

BACKGROUND OF THE INVENTION

In operating a wrench or a spanner such as for loosening a bolt nut from a rusty bolt, it may require a great force for rotating the nut trying to loosen the nut and the bolt so that a longer pipe P may be temporarily jacketed onto the wrench or spanner W as shown in FIG. 7 to increase a force arm and momentum for an easier opening of the bolt and nut. However, the pipe P may be slipped or released from the wrench handle to influence its operation.

It is therefore expected to disclose a wrench having a telescopic handle which can be optionally adjusted to a desired length for a convenient spanning operation therefor.

SUMMARY OF THE INVENTION

The object of the present invention is to provide a wrench including a handle portion of the wrench telescopically mounted in a handle sleeve having a locking bolt resiliently held on the handle sleeve for locking the handle portion in the handle sleeve by engaging the locking bolt with anyone transverse groove transversely formed in the handle portion, thereby providing a wrench having an adjustably telescopic handle.

DETAILED DESCRIPTION

Figure 7:
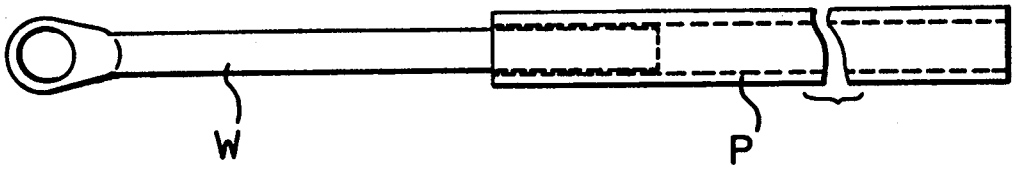
FIG. 7 PRIOR ART
FIG. 7 shows a prior art in operating a conventional wrench.
Figure 1:
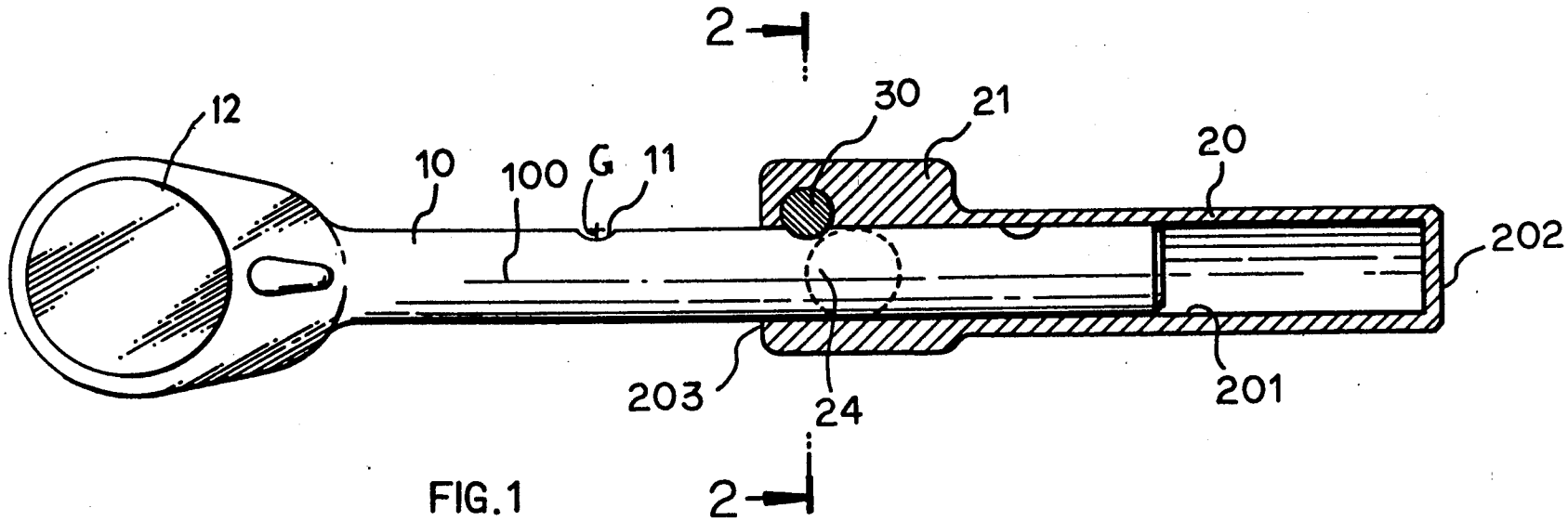
FIG. 1 is a partial sectional drawing of the present invention.
Figure 3:
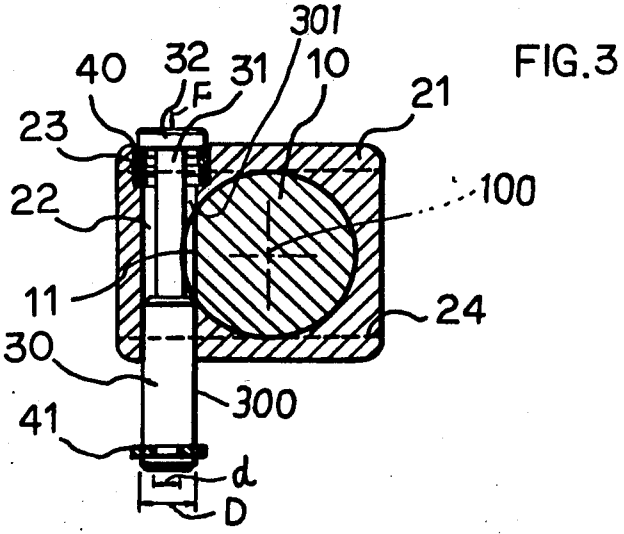
FIG. 3 is an illustration showing an adjustable telescopic operation for the present invention.
Figure 2:
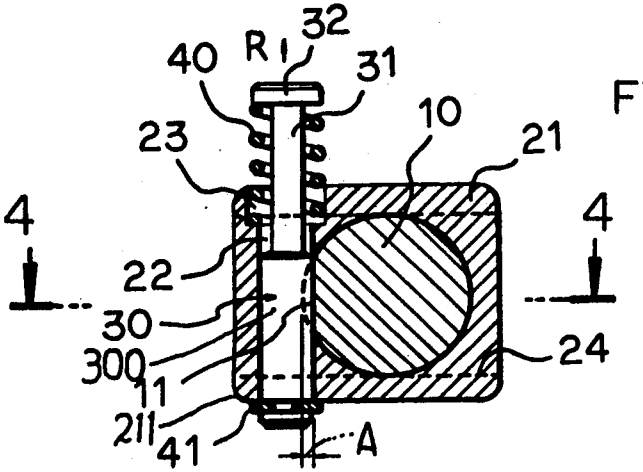
FIG. 2 is a cross sectional drawing of the present invention when viewed from 2—2 direction of FIG. 1.

As shown in FIGS. 1-3, the present invention comprises: a handle portion 10 having a head portion 12 formed on a first end portion of the handle portion 10, a handle sleeve 20, and a locking bolt 30.

The handle portion 10 includes: a head portion 12 formed on a first end portion of the handle portion 10 selected from a socket, a pair of jaws or a ring socket for fastening a bolt nut (not shown), and a plurality of transverse grooves 11 transversely recessed in the handle portion 10 and equally spaced to be longitudinally distributed on the handle portion 10, and a longitudinal axis 100 formed in a longitudinal center of the handle portion 10.

Figure 5:
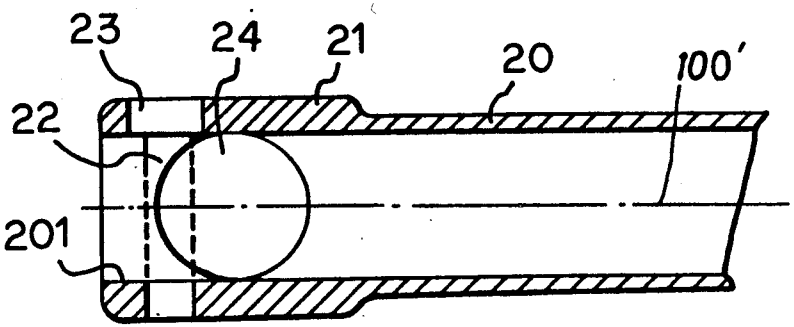
FIG. 5 is a sectional drawing of the present invention when viewed from 5—5 direction of FIG. 4.
Figure 6:
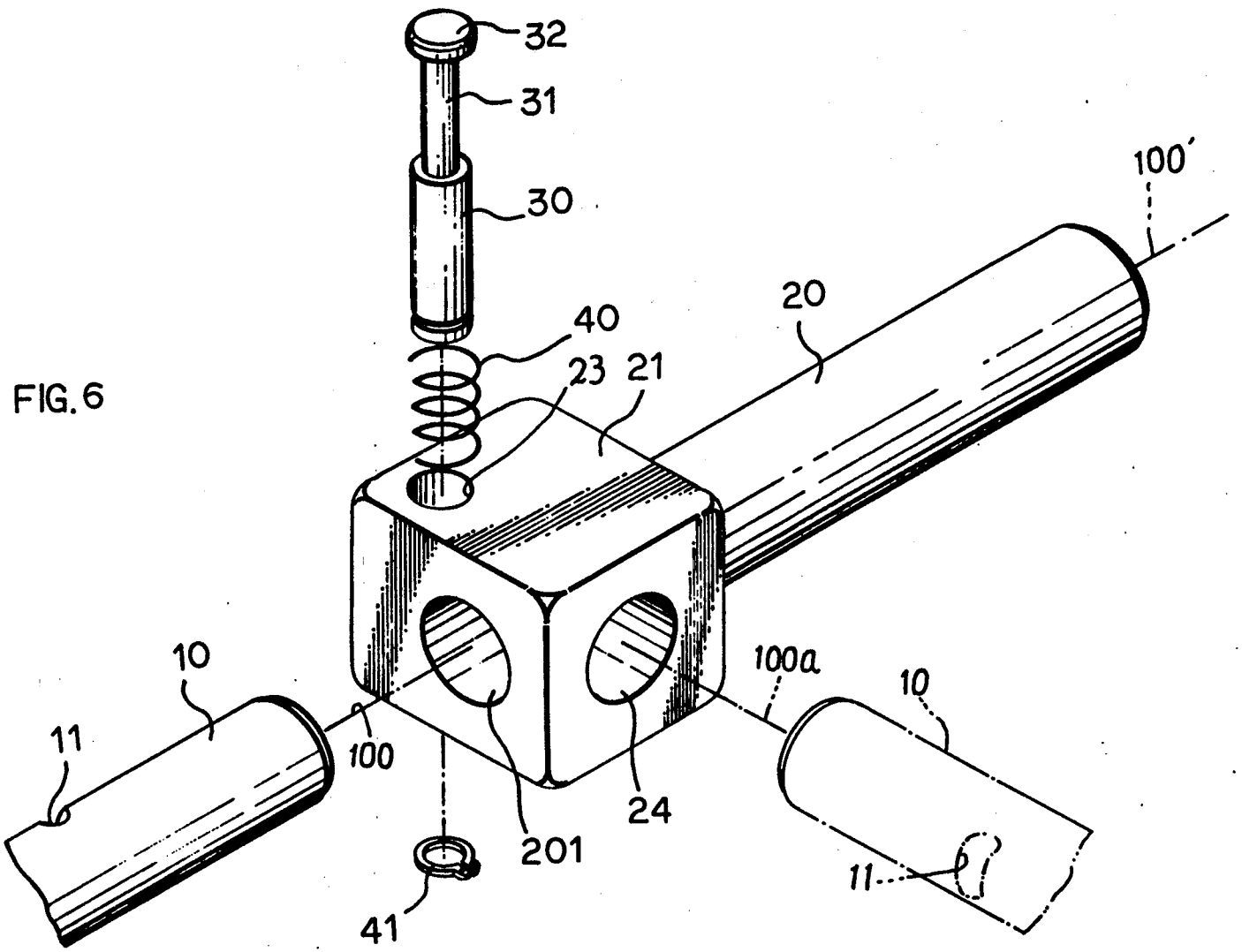
FIG. 6 is a perspective view showing the application of the present invention.

The handle sleeve 20 includes: a longitudinal hole 201 longitudinally formed in the sleeve 20 for telescopically holding a second end portion of the handle portion 10 opposite to the head portion 12 formed on the first end portion of the handle portion in the longitudinal hole 201, a closed end portion 202 formed on a bottom portion of the sleeve 20, and a flange portion 21 formed on an open end portion 203 of the sleeve opposite to the closed end portion 202. The longitudinal hole 201 defines a longitudinal axis 100' linearly aligned with the longitudinal axis 100 of the handle portion 10. The flange portion 21 is further formed a transverse hole 24 through the flange portion 21 perpendicularly intersecting the longitudinal hole 201 of the handle sleeve 20 and defining a transverse axis **100*a* formed in a center of the transverse hole 24 which is perpendicular to the longitudinal axis 100 formed in the handle portion 10 and in the longitudinal hole 201 of the handle sleeve 20** as shown in FIGS. 4-6.

Figure 4:
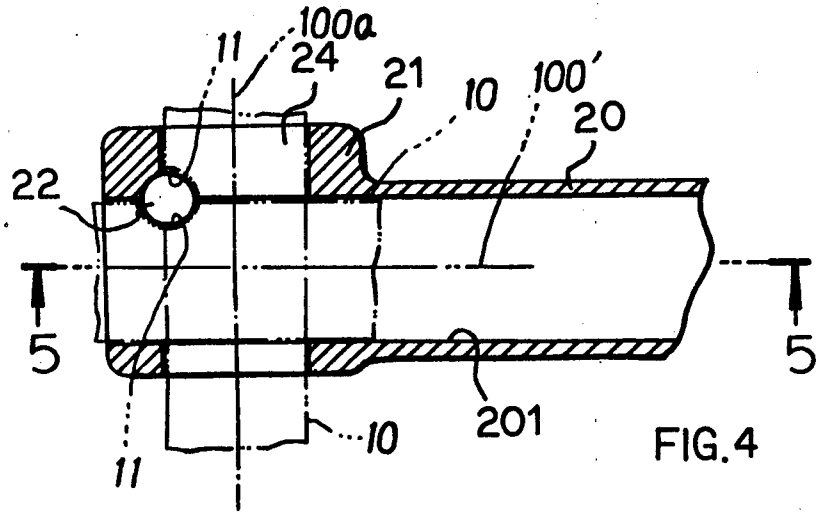
FIG. 4 is a sectional drawing of the present invention as viewed from 4—4 direction of FIG. 2.

The flange portion 21 is formed a bolt hole 22 through the flange portion 21 to be protectively perpendicular to the longitudinal axis 100' of the sleeve 20 and projectively perpendicular to the transverse axis **100*a* formed in the transverse hole 24 of the flange portion 21 with a perimeter of the bolt hole 22 perpendicularly intersecting a crossing junction intersected by a cross section of the longitudinal hole 201 and a cross section of the transverse hole 24** as shown in FIG. 4.

The locking bolt 30 includes: a bolt shank portion 300 having a neck portion 31 protruded linearly from the shank portion 300 to be slidably held in the bolt hole 22 transversely formed in the flange portion 21 of the sleeve 20 to be projectively perpendicular to the longitudinal axis 100' of the handle sleeve 20, a cap portion 32 formed on an outer end portion of the neck portion 31 of the bolt 30 resiliently retained outwardly by a tensioning spring 40 inserted in the spring socket 23 recessed in the flange portion 21, and a retainer ring 41 secured on an inner end portion of the bolt 30 opposite to the cap portion 32 for retaining the bolt 30 on the flange portion 21 of the sleeve 20. The tensioning spring 40 normally urges the cap portion 32 of the bolt 30 outwardly to engage the bolt shank portion 300 with anyone transverse groove 11 formed in the handle portion 10 for stably positioning and locking the handle portion 10 in the sleeve 20.

As shown in FIGS. 2, 3, the neck portion 31 of the bolt 30 is circumferentially recessed from the shank portion 300 of the bolt with a recess aperture 301 (A) defined between an outermost cylindrical surface of the shank portion 300 and an outermost cylindrical surface of the neck portion 31, the recess aperture 301 if being designated as A, an outside diameter of the shank portion 300 designated as D, and an outside diameter of the neck portion as d, a formula will be set as follows:

$$A=\tfrac{1}{2}(D-d).$$

If a depth of each said transverse groove 11 being designated as G, then, $$G=A=\tfrac{1}{2}(D-d).$$

Therefore, when the bolt shank portion 300 of the locking bolt 30 is engaged with the groove 11 of the handle portion 10 as shown in FIG. 2, the cap 32 will be urged upwardly by the tensioning spring 40 and the bolt 30 will be retained by the retainer ring 41 to ensure a stable engagement of the bolt 30 with the handle portion 10 to thereby lock the handle portion 10 on the flange portion 21 of the sleeve 20.

For adjusting a length of the handle portion 10 of the wrench, the cap 32 is depressed downwardly (F) as shown in FIG. 3 to retract the bolt shank portion 300 from the groove 11 to allow the narrow neck portion 31 of the bolt 30 slidably contacting with an outermost cylindrical surface of the handle portion 10 until meeting a specific location for re-engaging the bolt 30 with the groove 11, and the cap 32 is then released to allow the spring 40 to urge the cap 32 upwardly (R) to engage the shank portion 300 with the groove 11 for locking and positioning the handle portion 10 in the handle sleeve 20.

Accordingly, the present invention provides a telescopic means for telescopically adjusting a length of the wrench handle, suitable for a convenient spanning operation. If after finishing the job, the wrench can be shortened by retracting all the handle portion 10 into the sleeve 20 for a compact handling or storage purpose.

The present invention may be applied to a spanner, a shifting wrench, a pipe wrench or any other tools as modified by those skilled in the art.

As shown in FIGS. 6 and 4, the handle portion 10 may also be inserted into the transverse hole 24 to be perpendicularly adjusted on the flange portion 21 of the handle sleeve 20 so that the handle portion 10 may either be linearly engaged in the sleeve 20 or perpendicularly adjustably held on the sleeve 20. If the handle portion 10 is perpendicularly secured on the sleeve 20 when inserted in the transverse hole 24 and locked on the sleeve by engaging the locking bolt 30 in the bolt hole 22 with the handle groove 11, a generally L-shaped or T-shaped configuration will be formed for optionally adjusting a turning moment and also for operational convenience of the invention in a narrow working site or space as limited or retarded by environmental structures of factors. Therefore, the present invention may be operated adjustably, telescopically in a very convenient way.

I claim:

1. A wrench comprising:

a handle portion having a head portion formed on a first end portion of the handle portion selected from a socket, a pair of jaws and a ring socket, and a plurality of transverse grooves transversely recessed in the handle portion and equally spaced to be longitudinally distributed on the handle portion, and a longitudinal axis formed in a longitudinal center of the handle portion;

a handle sleeve telescopically receiving said handle portion within said sleeve, having a longitudinal hole longitudinally formed in the sleeve for telescopically holding a second end portion of the handle portion opposite to the head portion, a closed end portion formed on a bottom portion of the sleeve, and a flange portion formed on an open end portion of the sleeve opposite to the closed end portion for holding said locking bolt thereon; and a locking bolt resiliently held in said handle sleeve normally engaging said handle portion for locking and positioning said handle portion in said handle sleeve, said locking bolt including: a bolt shank portion having a neck portion protruded linearly from the shank portion to be slidably held in a bolt hole transversely formed in the flange portion of the sleeve to be projectively perpendicular to said longitudinal axis centrally formed in the handle portion, a cap portion formed on an outer end portion of the neck portion of the bolt resiliently retained outwardly by a tensioning spring inserted in a spring socket recessed in the flange portion, and a retainer ring secured on an inner end portion of the bolt opposite to the cap portion for retaining the bolt on the flange portion of the sleeve; said tensioning spring normally urging the cap portion of the bolt outwardly to engage the bolt shank portion with a transverse groove formed in the handle portion for stably positioning and locking the handle portion in the sleeve, whereby upon a disengagement of said locking bolt from said handle portion, said handle portion can be telescopically adjusted for its length protruded outwardly from said handle sleeve and upon a further engagement of said handle portion with said locking bolt, said handle portion will be stably locked on said handle sleeve for operating purpose.

2. A wrench according to claim 1, wherein said neck portion of the bolt is circumferentially recessed from the shank portion of the bolt with a recess aperture defined between an outermost cylindrical surface of the shank portion and an outermost cylindrical surface of the neck portion, the recess aperture being designated as A, an outside diameter of the shank portion designated as D, and an outside diameter of the neck portion as d, a formula is obtained as:

$$A=\tfrac{1}{2}(D-d),$$

if a depth of each said transverse groove being designated as G, then, $$G=A=\tfrac{1}{2}(D-d).$$

3. A wrench according to claim 1, wherein said longitudinal hole of said handle sleeve defines a longitudinal axis linearly aligned with the longitudinal axis of the handle portion, said flange portion forming a transverse hole through the flange portion perpendicularly intersecting the longitudinal hole of the handle sleeve and defining a transverse axis formed in a center of the transverse hole which is perpendicular to the longitudinal axis formed in the handle portion and in the longitudinal hole of the handle sleeve, said flange portion forming a bolt hole through the flange portion to be projectively perpendicular to the longitudinal axis of the sleeve and projectively perpendicular to the transverse axis formed in the transverse hole of the flange portion with a perimeter of the bolt hole perpendicularly intersecting a crossing junction intersected by a cross section of the longitudinal hole and a cross section of the transverse hole, thereby allowing the handle portion to be perpendicularly secured on the sleeve when inserted in the transverse hole and locked on the sleeve by engaging the locking bolt in the bolt hole with the handle groove to form a generally L-shaped or T-shaped configuration for optionally adjusting a turning moment and for and operational convenience of the wrench.

* * * * *